US011137791B2

(12) United States Patent
Hernandez et al.

(10) Patent No.: US 11,137,791 B2
(45) Date of Patent: Oct. 5, 2021

(54) KNOB ASSEMBLY

(71) Applicant: WHIRLPOOL CORPORATION, Benton Harbor, MI (US)

(72) Inventors: Tzeitel Adriana Hernandez, St. Joseph, MI (US); Satish Janardhan Kathar, Maharashtra (IN); Yokesh S, Tamil Nadu (IN)

(73) Assignee: Whirlpool Corporation, Benton Harbor, MI (US)

( * ) Notice: Subject to any disclaimer, the term of this patent is extended or adjusted under 35 U.S.C. 154(b) by 51 days.

(21) Appl. No.: 16/524,796

(22) Filed: Jul. 29, 2019

(65) Prior Publication Data

US 2021/0034093 A1 Feb. 4, 2021

(51) Int. Cl.

| | |
|---|---|
| ***G05G 1/10*** | (2006.01) |
| ***F24C 3/12*** | (2006.01) |
| ***H01H 3/02*** | (2006.01) |
| ***H01H 3/08*** | (2006.01) |

(52) U.S. Cl.

CPC ..... *G05G 1/10* (2013.01); *F24C 3/126* (2013.01); *H01H 3/08* (2013.01)

(58) Field of Classification Search

CPC .. G05G 1/08; G05G 1/10; G05G 1/12; G05G 5/02; G05G 5/04; G05G 5/06; H01H 3/08; H03J 5/06; H03J 5/12; F24C 3/126

See application file for complete search history.

(56) References Cited

U.S. PATENT DOCUMENTS

| | | | | |
|---|---|---|---|---|
| 1,116,902 | A * | 11/1914 | Lorenz | H01H 3/08 200/338 |
| 4,936,162 | A * | 6/1990 | Tronetti, Jr. | G05G 1/12 16/441 |
| 5,121,653 | A | 6/1992 | Sigler | |
| 5,384,442 | A | 1/1995 | Danner | |
| 6,900,406 | B2 | 5/2005 | Huber | |
| 7,285,738 | B2 | 10/2007 | Lavigne et al. | |
| 7,870,810 | B2 | 1/2011 | Da Dalt et al. | |
| 8,534,160 | B2 | 9/2013 | Giuliani et al. | |
| 8,801,118 | B2 * | 8/2014 | Park | D06F 34/28 312/228 |
| 10,114,405 | B2 | 10/2018 | Swayne et al. | |
| 10,409,314 | B2 * | 9/2019 | Turner | G05G 1/105 |
| 10,732,665 | B2 * | 8/2020 | Ha | F24C 3/008 |
| 2003/0221498 | A1 * | 12/2003 | Mere | H01H 3/10 74/10.2 |

(Continued)

FOREIGN PATENT DOCUMENTS

| | | | | |
|---|---|---|---|---|
| DE | 2501278 A1 | 7/1976 | | |
| DE | 102005051729 B3 * | 2/2007 | | G05G 1/10 |
| EP | 3367407 B1 | 8/2018 | | |

(Continued)

*Primary Examiner* — Adam D Rogers

(74) *Attorney, Agent, or Firm* — Price Heneveld LLP

(57) ABSTRACT

A knob assembly includes a first housing with a sidewall extending from a base and a retention member inwardly extends from the sidewall. An operable second housing includes a selective stopper selectively movable between a first position and a second position relative to the retention member. The operable second housing is further axially operable between a compressed position and an extended position relative to the first housing, and the operable second housing includes a biasing member.

15 Claims, 12 Drawing Sheets

(56) References Cited

U.S. PATENT DOCUMENTS

| | | | |
|---|---|---|---|
| 2007/0295589 | A1 | 12/2007 | Lipp et al. |
| 2018/0238465 | A1 | 8/2018 | Ha |

FOREIGN PATENT DOCUMENTS

| | | | | |
|---|---|---|---|---|
| JP | 10238784 | A | 9/1998 | |
| WO | 2010049336 | A1 | 5/2010 | |
| WO | WO-2016084625 | A1 * | 6/2016 | ..... B62D 5/005 |

* cited by examiner

KNOB ASSEMBLY

BACKGROUND OF THE DISCLOSURE

The present disclosure generally relates to an appliance, and more specifically, to a knob assembly for an appliance.

SUMMARY OF THE DISCLOSURE

According to one aspect of the present disclosure, an appliance includes a front panel having an exterior surface and an interior surface. A knob assembly is rotationally coupled to the front panel. The knob assembly includes a first housing having a sidewall and a retention member inwardly extending from the sidewall. An operable second housing is rotationally operable and axially operable relative to the first housing and having a body and a selective stopper disposed on a surface of the body. The selective stopper is selectively movable between a first position and a second position relative to the retention member. An axial biasing member is disposed between the first housing and the operable second housing.

According to another aspect of the present disclosure, a knob assembly for an appliance includes a first housing having a sidewall defining a cavity and a retention member. An operable second housing includes a selective stopper disposed on a surface of a body. The selective stopper is selectively movable between a first position and a plurality of second positions relative to the retention member. A biasing member is disposed between the first housing and the operable second housing that defines a compressed position and an extended position of the operable second housing.

According to yet another aspect of the present disclosure, a knob assembly includes a first housing having a sidewall extending from a base and a retention member inwardly extending from the sidewall. An operable second housing includes a selective stopper that is selectively movable between a first position and a second position relative to the retention member. The operable second housing is further axially operable between a compressed position and an extended position relative to the first housing. The operable second housing includes a biasing member.

These and other features, advantages, and objects of the present disclosure will be further understood and appreciated by those skilled in the art by reference to the following specification, claims, and appended drawings.

Figure 1:
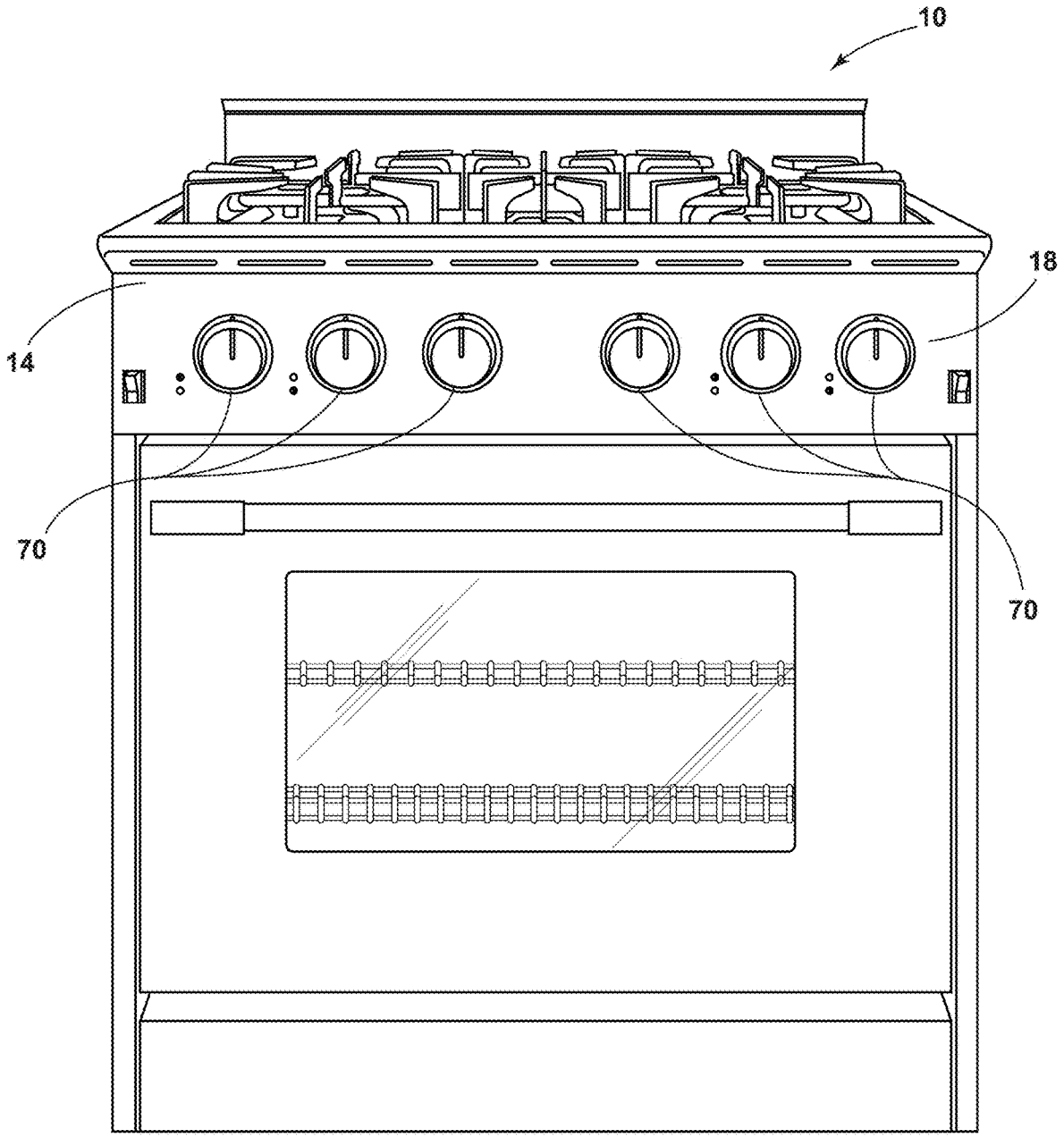
FIG. 1 is a front perspective view of an appliance of the present disclosure.
Figure 2:
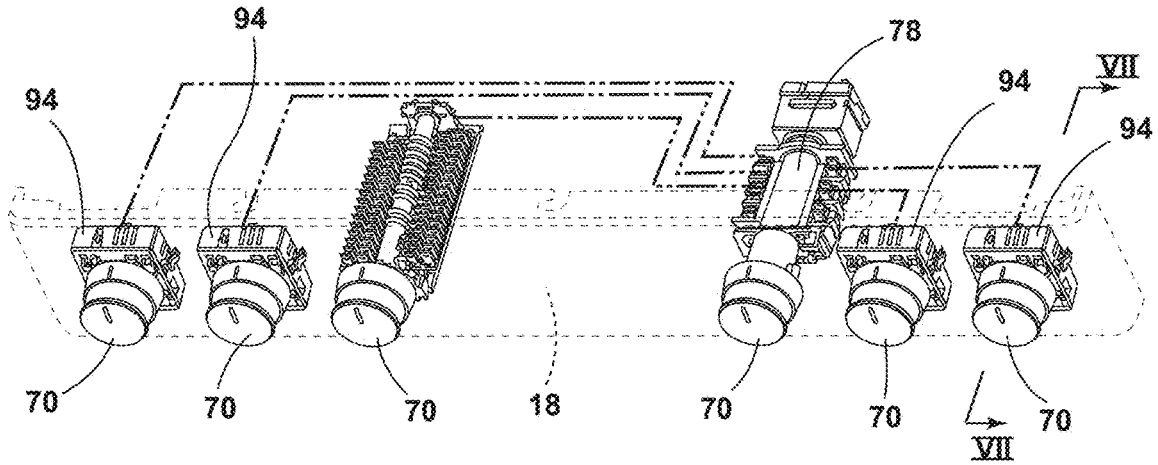
FIG. 2 is a top schematic perspective view of a knob assembly of an appliance of the present disclosure.
Figure 3:
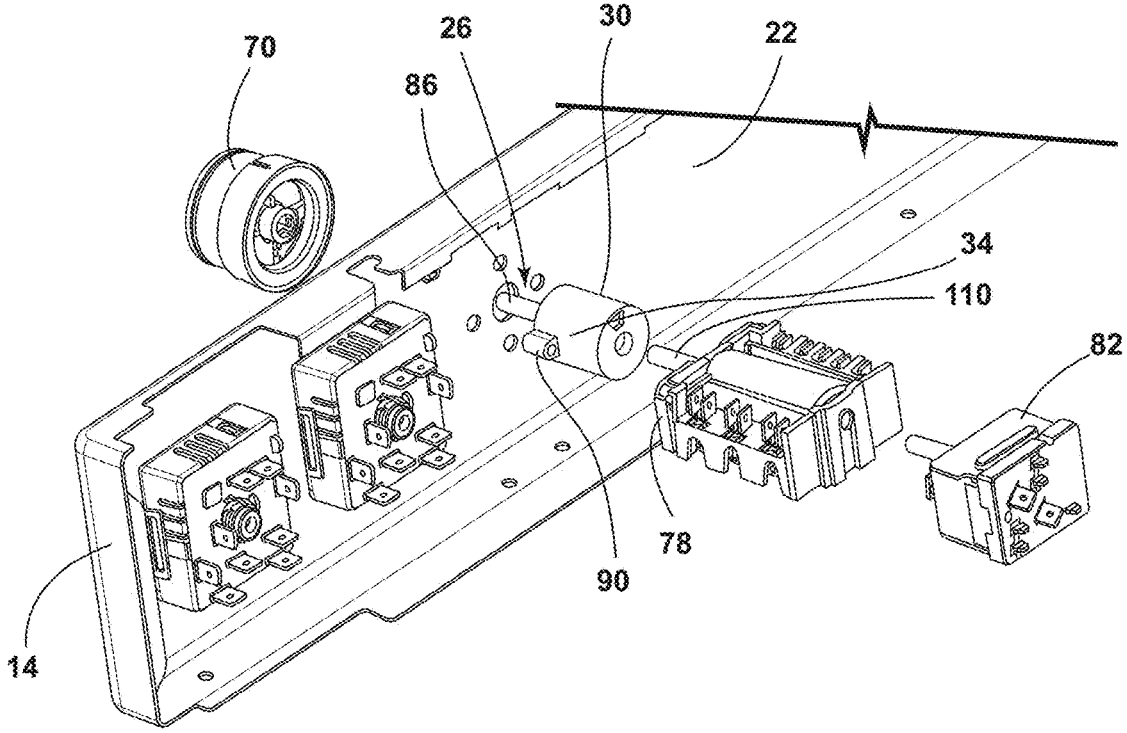
FIG. 3 is a partial exploded top perspective view of a knob assembly of the present disclosure.
Figure 4:
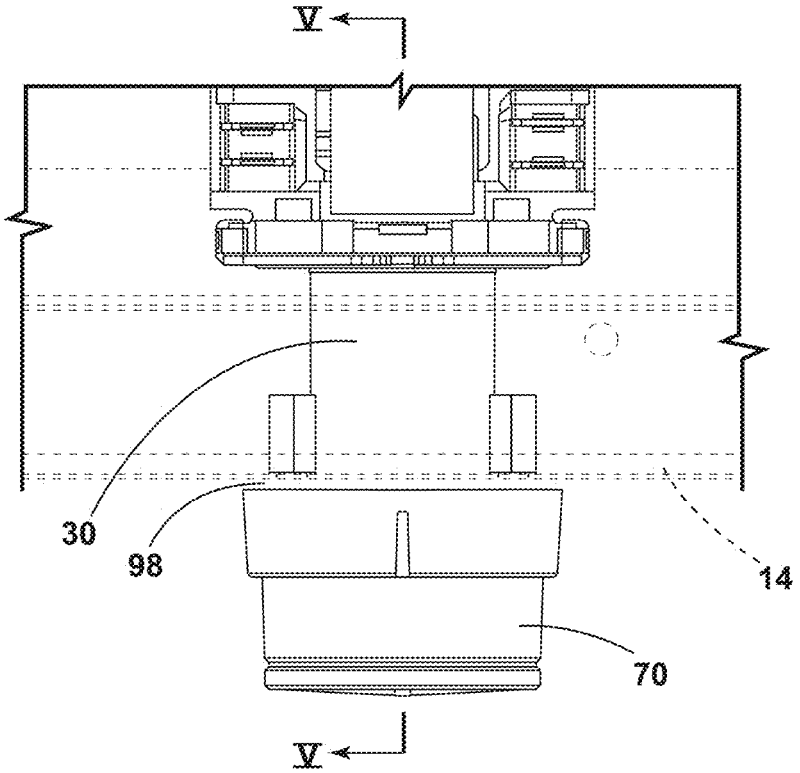
FIG. 4 is a partial top view of a front panel and a knob assembly of the present disclosure.

The components in the figures are not necessarily to scale, emphasis instead being placed upon illustrating the principles described herein.

DETAILED DESCRIPTION

The present illustrated embodiments reside primarily in combinations of apparatus components related to a knob assembly. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-20, reference numeral 10 generally designates an appliance including a front panel 14 having an exterior surface 18, an interior surface 22, and a knob assembly 26 rotationally coupled to the front panel 14. The knob assembly 26 includes a first housing 30 having a sidewall 34 and a retention member 38 inwardly extending from the sidewall 34. An operable second housing 42 is rotationally operable and axially operable relative to the first housing 30. The operable second housing 42 also includes a body 46 and a selective stopper 50 disposed on a surface 54 of the body 46. The selective stopper 50 is selectively movable between a first position 58 and a second position 62 relative to the retention member 38. An axial biasing member 66 is disposed between the first housing 30 and the operable second housing 42.

Referring again to FIGS. 1-3, the front panel 14 of the appliance 10 includes a plurality of knob caps 70 that are coupled to portions of the knob assembly 26. The knob caps 70 and the knob assembly 26 are part of a user interface 74 with an electromechanical switch 78 that assists in providing an energy source for the appliance 10, typically electricity or gaseous fuel. The electromechanical switch 78 may be further coupled to a thermostat switch 82 that at least partially controls the temperature range of a portion of the appliance 10, such as a burner or heating cavity. Typically, the electromechanical switch 78 may have an operating rotational range of 0-degrees to approximately 330-degrees about a rotational axis. The knob caps 70 are rotationally operable relative to the exterior surface 18 of the front panel 14 and can include various temperature-related indicia to indicate to a user a range of temperatures available. Generally, when rotating the knob caps 70, typically, in a clockwise direction, the temperature may be increased, and by rotating the knob caps 70, typically, in a counterclockwise direction, the temperature may be decreased.

The knob caps 70 may be affixed onto an elongated portion 86 of the operable second housing 42 (FIG. 5) to give further operability to the user interface 74. For example, the operable second housing 42 may be generally movable relative to the front panel 14, whereas the first housing 30 of the knob assembly 26 is typically coupled to the interior surface 22 of the front panel 14 via fastening portions 90 laterally extending from the sidewall 34. Accordingly, the first housing 30 is typically fixed relative to the interior surface 22 of the front panel 14. The knob assembly 26 may be incorporated directly with the electromechanical switch 78 or indirectly by coupling to an electric switch 94 that then interfaces with the electromechanical switch 78 to control and regulate the energy supply. In either the direct or indirect arrangement, the first housing 30 of the knob assembly 26 may couple to the interior surface 22 of the front panel 14, and the elongated portion 86 extends through the front panel 14 and couples to the knob caps 70. It should be understood that in certain aspects of the device the elongated portion 86 can extend from the knob cap 70 and extend into the operable second housing 42.

Referring again to FIGS. 4 and 5, a space 98 is defined between the knob cap 70 and the front panel 14, such that the knob cap 70 may be axially operated. Although the knob cap 70 may be axially operated to an extent that the knob cap 70 may fully close the space 98 between the knob cap 70 and the front panel 14, it is also generally contemplated that the space 98 is reduced rather than eliminated entirely. Axial operation is due to operability of the second housing 42 relative to the first housing 30 in at least an axial direction. Additionally as illustrated, the knob cap 70 includes a receiving member 102 in which the elongated portion 86 is positioned. The elongated portion 86 may be fastened or coupled to the receiving member 102, such that the knob cap 70 may be easily removable. The operable second housing 42 also includes a central portion 106, which is hollow so that an encoder 110 of the electromechanical switch 78 may be received within the central portion 106.

Although the encoder 110 may be positioned within the central portion 106, a pocket 114 may be defined between the central portion 106 and the encoder 110. The pocket 114 allows the central portion 106 to axially move relative to the encoder 110 and contact the encoder 110 to activate the electromechanical switch 78. The operable second housing 42 is positioned within a cavity 122 (FIG. 6) of the first housing 30, such that a gap 126 is defined between a base 130 of the first housing 30 and a base edge 134 of the operable second housing 42. Accordingly, a user may push the knob cap 70 to close the space 98 between the knob cap 70 and the front panel 14 and simultaneously close both the pocket 114 between the central portion 106 and the encoder. In addition, while the space 98 between the knob cap 70 and the front panel 14 may remain, the gap 126 between the base 130 of the first housing 30 and the base edge 134 of the operable second housing 42 is generally closed, such that the base edge 134 touches the base 130.

Figure 5:
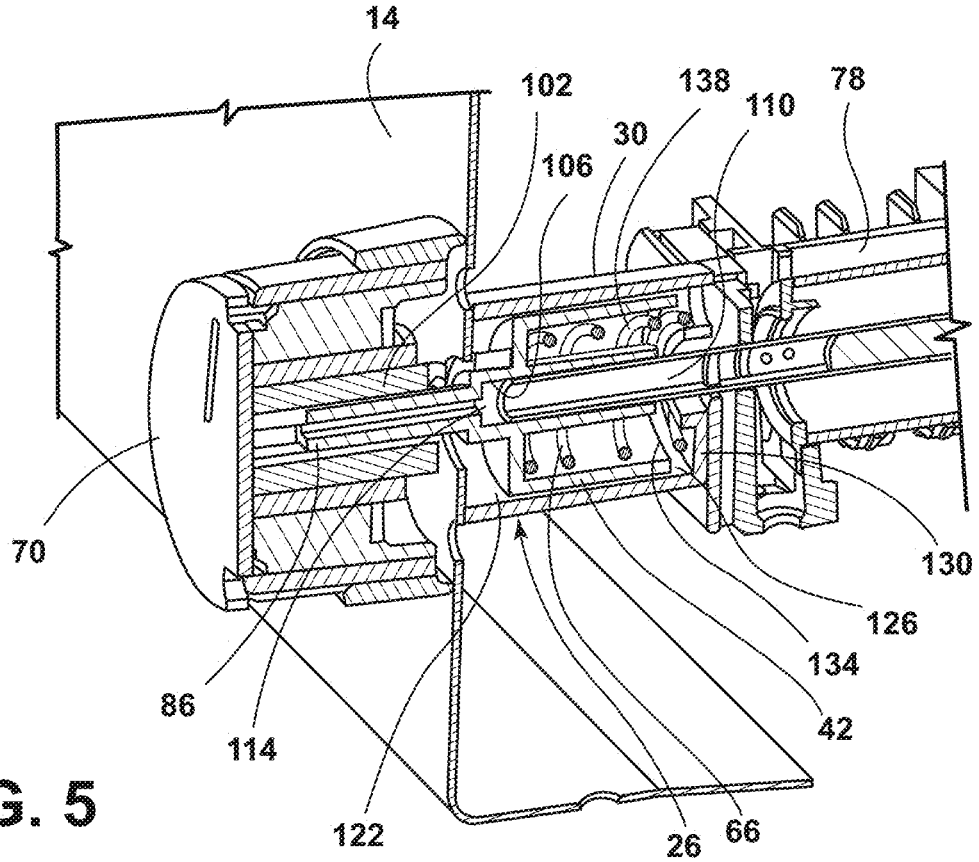
FIG. 5 is a cross-sectional view of a knob assembly of the present disclosure.
Figure 6:
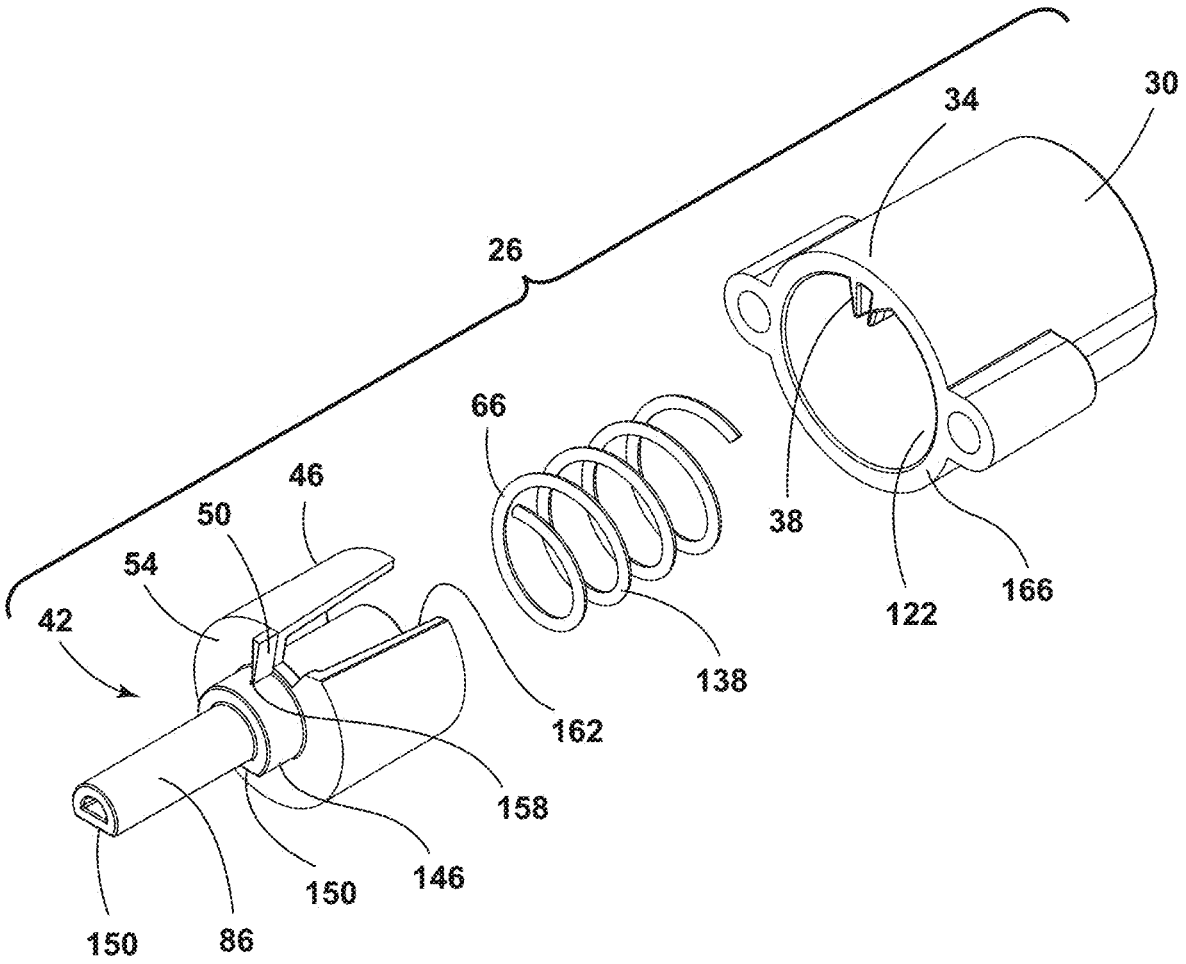
FIG. 6 is an exploded view of a first housing, a biasing member, and an operable second housing of a knob assembly of the present disclosure.

In actuating the knob assembly 26, the knob cap 70 presses on the elongated portion 86 of the operable second housing 42, which axially shifts the operable second housing 42 relative to the first housing 30. The biasing member 66 acts to extend the operable second housing 42 once the compressive force is removed from the knob cap 70. As depicted in FIG. 5, the biasing member 66 is a helical spring 138 that is disposed in the cavity 122 of the first housing 30 and wraps around the central portion 106 of the operable second housing 42. The base 130 of the first housing 30 abuts and couples to a side of the electromechanical switch 78 such that when the biasing member 66 is compressed, pressure is applied to the base 130 of the first housing 30 as well as the side of the electromechanical switch 78. Upon compression, the knob cap 70 may then rotate the operable second housing 42 via the elongated portion 86 and in turn rotate the encoder 110 via the central portion 106, activating the electromechanical switch 78.

Referring again to FIGS. 6-8, 16, and 17, the elongated portion 86 extends from a plinth 146 disposed on the surface 54 of the body 46. Both the plinth 146 and the elongated portion 86 may be generally arcuate or semicircular in shape such that a flat side 150 of each of the elongated portion 86 and the plinth 146 partially defines the first position 58 of the operable second housing 42 when the flat sides 150 are parallel with a bottom edge 154 of the front panel 14. Furthermore as illustrated, the selective stopper 50 is generally positioned at a predefined angular position 158 of the plinth 146 further defining the first position 58.

As illustrated, the selective stopper 50 is a flange, such as a wedge shape that comes to a point at the predefined angular position 158 of the plinth 146. However, the selective stopper 50 may have alternative configurations such as a peg, pin, rib, or any other comparative protrusion generally known in the art. In addition, the body 46 of the operable second housing 42 may include an angular opening 162 that may correspond with the retention member 38 of the first housing 30. The construction of the operable second housing 42 with the angular opening 162 may allow for ease in assembly of the knob assembly 26 as the angular opening 162 may be manufactured, such that the retention member 38 easily aligns with the angular opening 162. This form of manufacture is typically referred to as poka-yoke, or mistake-proofing, which minimizes mistakes during assembly of the structure, here the knob assembly 26.

It is generally contemplated that during assembly the biasing member 66 may be positioned within the cavity 122 of the first housing 30, and the retention member 38 of the first housing 30 may be positioned within the angular opening 162 of the operable second housing 42. As shown, when assembled, the plinth 146 may generally be aligned with a perimeter edge 166 of the sidewall 34 of the first housing 30. Accordingly, the surface 54 of the body 46 of the operable second housing 42 may generally be within the cavity 122 of the first housing 30, such that the body 46 may be entirely surrounded by the sidewall 34 of the first housing 30. Alternatively, the plinth 146 may extend beyond the perimeter edge 166 of the sidewall 34, such that the surface 54 of the operable second housing 42 may be aligned with the perimeter edge 166 of the sidewall 34.

Figure 7:
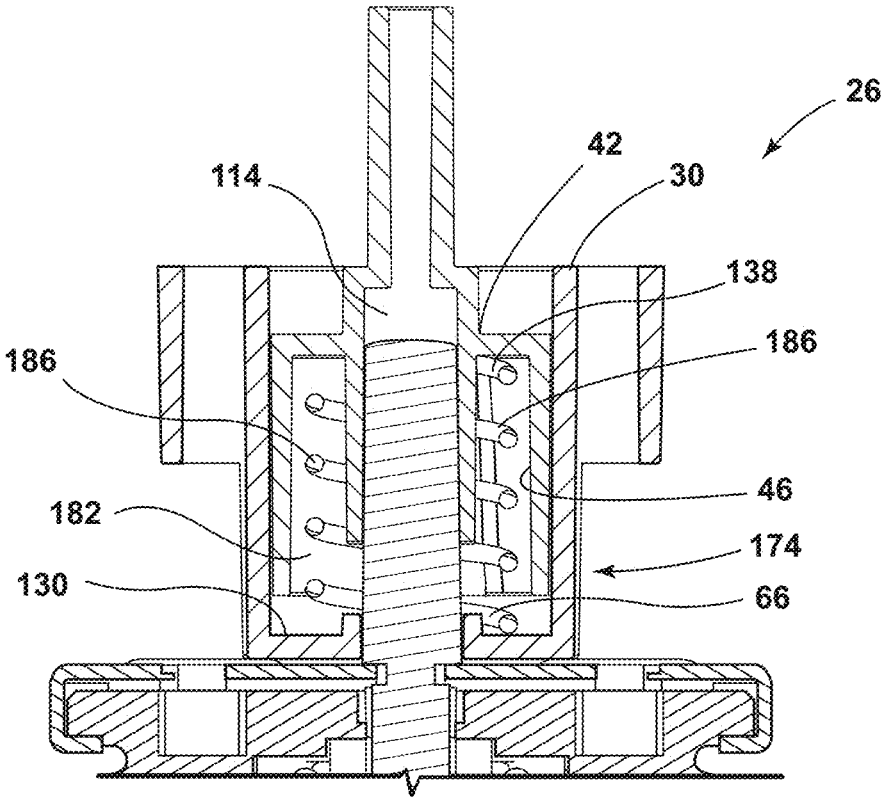
FIG. 7 is a cross-sectional view of a knob assembly of FIG. 2, taken along line VII-VII, and shown in an extended position.
Figure 8:
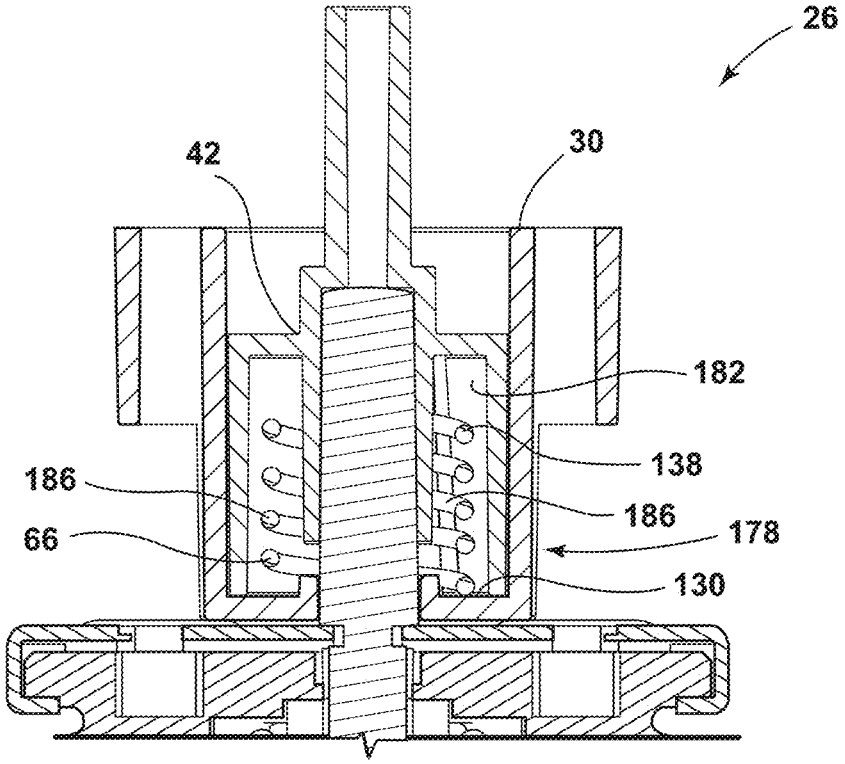
FIG. 8 is a cross-sectional view of a knob assembly of FIG. 7, shown in a compressed position of the present disclosure.

With further reference to FIGS. 7 and 8, the knob assembly 26 is in either extended or compressed positions 174, 178. When the knob assembly 26 is in the extended position 174, the biasing member 66 may be generally relaxed or minimally compressed such that there is minimal tension acting on the biasing member 66. Additionally, in either the extended or compressed positions 174, 178, the biasing member 66 may be in at least partial contact with an inner surface 182 of the body 46 of the operable second housing 42 as well as the base 130 of the first housing 30. Biasing force is continually exerted to bias the operable second housing 42 to the extended position 174. However, in certain types of biasing members 66, when the biasing member 66 is in the compressed position 178, the biasing member 66 may increase the biasing force exerted between both the first housing 30 and the operable second housing 42 at the base 130 and the inner surface 182, respectively. As illustrated in FIGS. 7 and 8, the biasing member 66 is the helical spring 138 such that coils 186 of the helical spring 138 will come into contact with one another. Once the biasing force that is applied to the knob assembly 26 to place the biasing member 66 in the compressed position 178 is released, the biasing member 66 biases the operable second housing 42 back to the extended position 174. Accordingly, the biasing member 66 and the operable second housing 42 are a resilient assembly, such that the biasing member 66 will return to the extended position 174 without additional engagement of the biasing member 66. The resiliency of the biasing member 66 will also result in rebound of the operable second housing 42 to the extended position 174.

Figure 9:
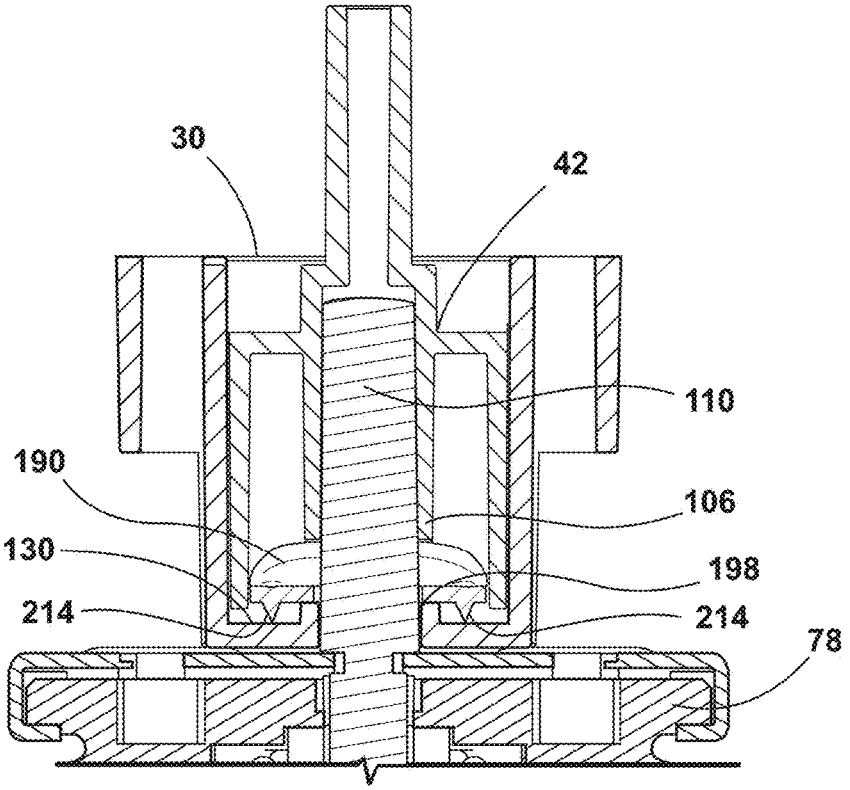
FIG. 9 is a cross-sectional view of a knob assembly of the present disclosure.
Figure 10:
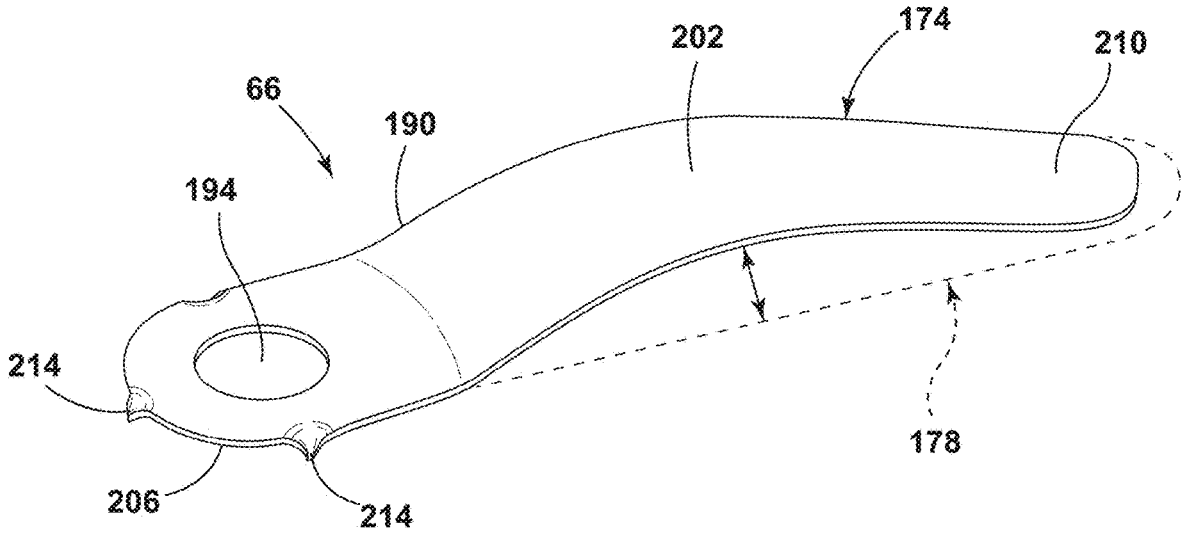
FIG. 10 is a side perspective view of a biasing member of FIG. 9.

Referring again to FIGS. 9 and 10, the biasing member 66 may have various configurations that are similarly resilient like the helical spring 138 (FIGS. 7 and 8). For example, a leaf spring 190 contains a hole 194 that may be aligned with the central portion 106 of the operable second housing 42 and a central opening 198 in the base 130 of the first housing 30 through which the encoder 110 of the electromechanical switch 78 extends. Accordingly, the encoder 110 may extend through the hole 194 of the leaf spring 190. As shown, the leaf spring 190, unlike the helical spring 138, has a generally protracted body with an arcuate center 202 and first and second flat ends 206, 210. The hole 194 is defined by the first flat end 206, but the hole 194 may alternatively be defined by the second flat end 210. As illustrated in FIG. 9, the first flat end 206 includes feet 214 that keep the first flat end 206 slightly separated relative to the base 130 of the first housing 30. During compression, the operable second housing 42 is axially pressed into the compressed position 178, such that the central portion 106 presses against the leaf spring 190 and the arcuate center 202 generally flattens to the compressed position 178 in response to the compressive force. Once the compressive force is released from the operable second housing 42, the leaf spring 190 will rebound to the extended position 174.

Figure 11:
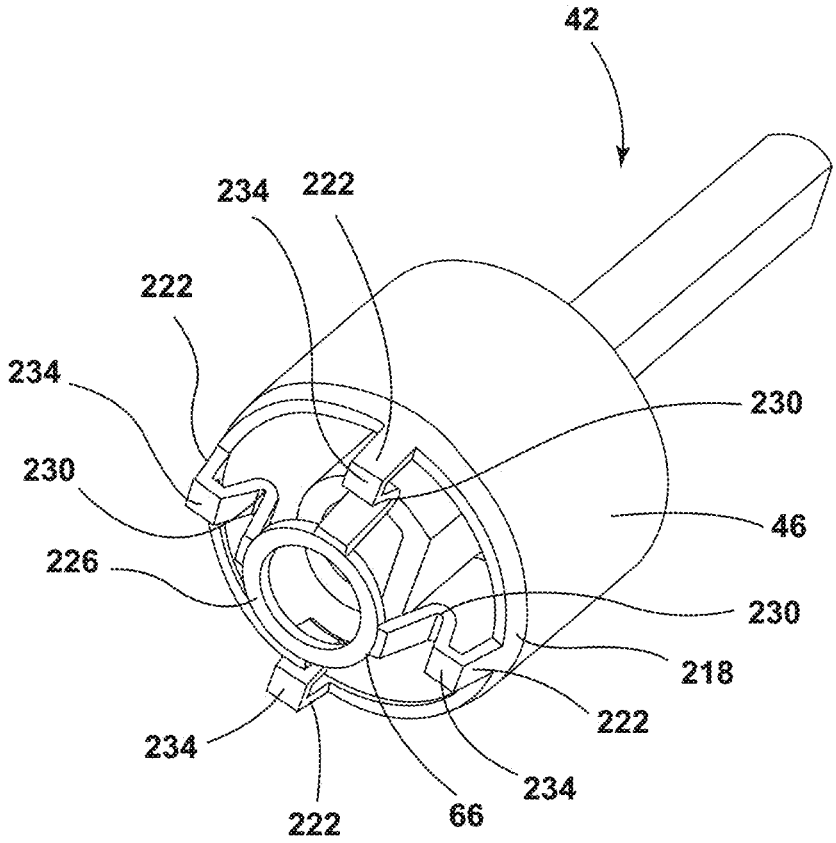
FIG. 11 is a bottom perspective view of a biasing member integral to an operable second housing of a knob assembly of the present disclosure.
Figure 12:
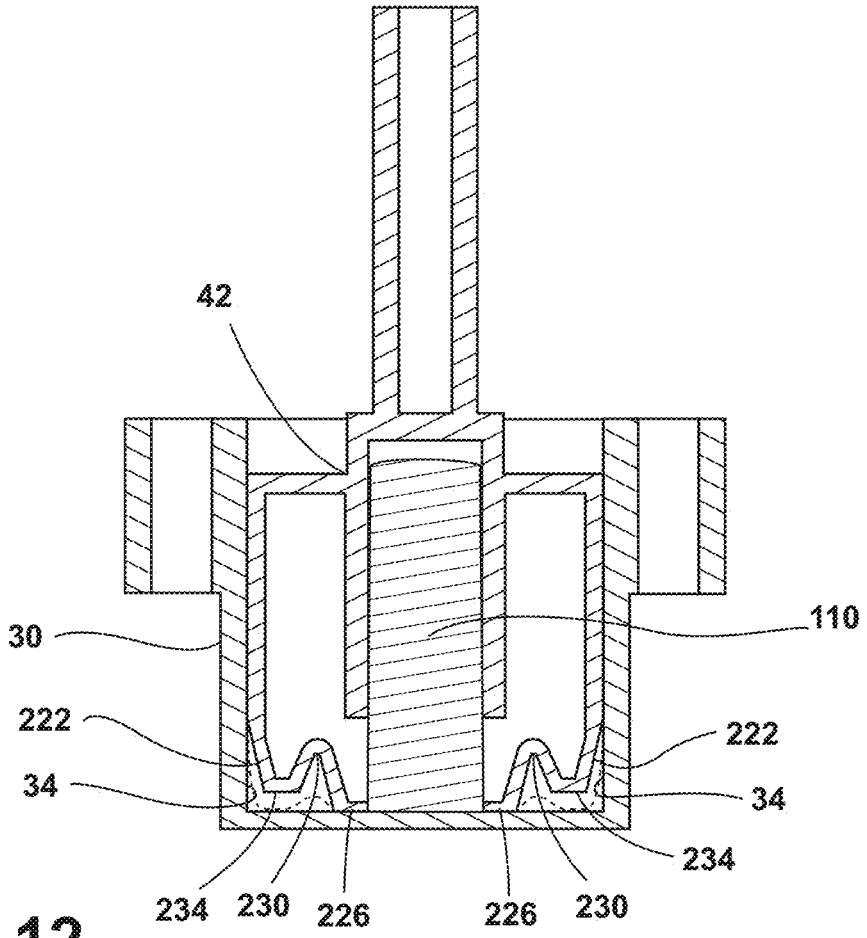
FIG. 12 is a cross-sectional view of the biasing member of FIG. 11.
Figure 13:
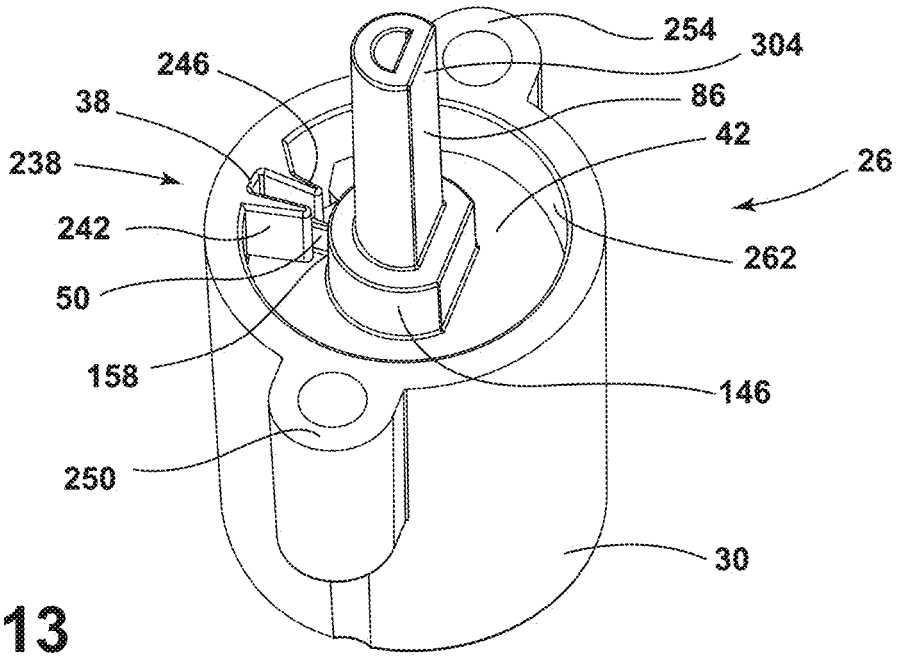
FIG. 13 is a side perspective view of a knob assembly of the present disclosure.
Figure 14:
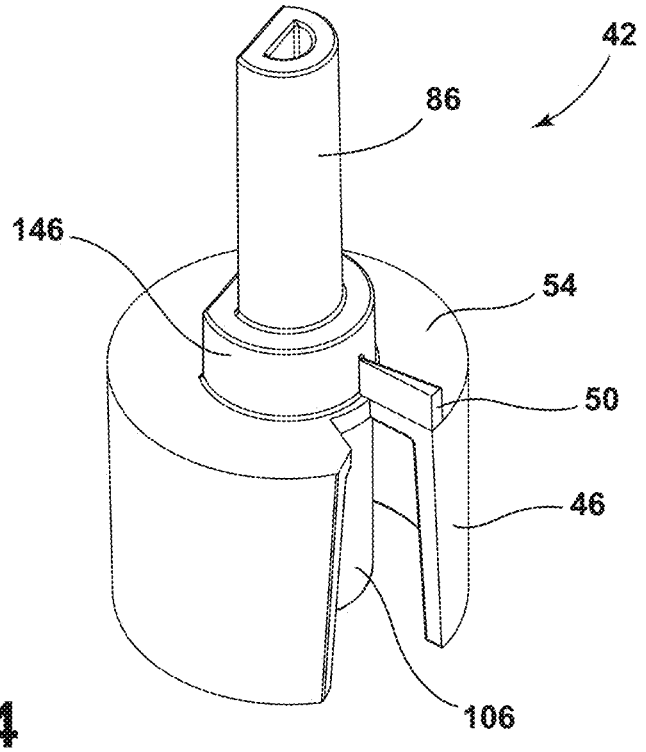
FIG. 14 is a side perspective view of an operable second housing of a knob assembly of the present disclosure.
Figure 15:
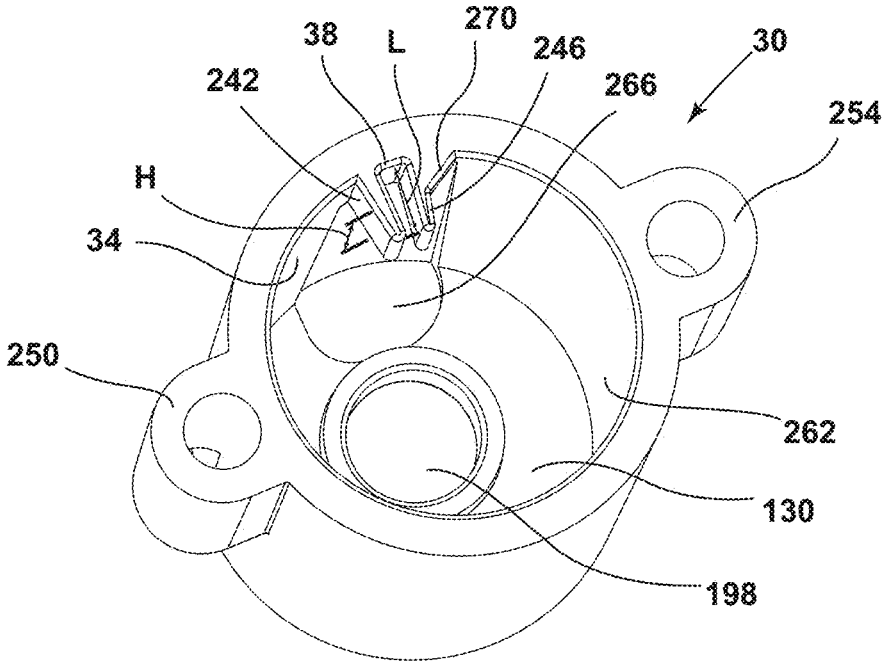
FIG. 15 is a side perspective view of a first housing of a knob assembly of the present disclosure.

Referring now to FIGS. 11 and 12, it is generally contemplated that the biasing member 66 may either be an independent feature such as the helical spring 138 or the leaf spring 190, or the biasing member 66 may be integrally formed with the operable second housing 42. As depicted in FIG. 11, the biasing member 66 is integral to a lower portion 218 of the operable second housing 42, such that compression portions 222 extend between the body 46 of the operable second housing 42 and a support member 226 of the biasing member 66. The support member 226 is depicted as being generally circular in shape with an open center. Alternatively, the support member 226 may be any other shape known in the art so long as the shape can accommodate the encoder 110.

The compression portions 222 are defined by living hinges 230 in that the living hinges 230 are integrally formed with the compression portions 222. The living hinges 230 may be formed from known methods such as injection molding of materials, for example, plastic. The compression portions 222 depicted in FIGS. 11 and 12 also include a flat portion 234 coupled to the living hinges 230, which will bias, along with the support member 226, against the base 130 of the first housing 30 in the compressed position 178. Moreover, the compression portions 222 may be angled inward toward the support member 226, which allows the compression portions 222 to flex outward when in the compressed position 178, such that the compression portions 222 abut the sidewall 34 of the first housing 30.

Figure 16:
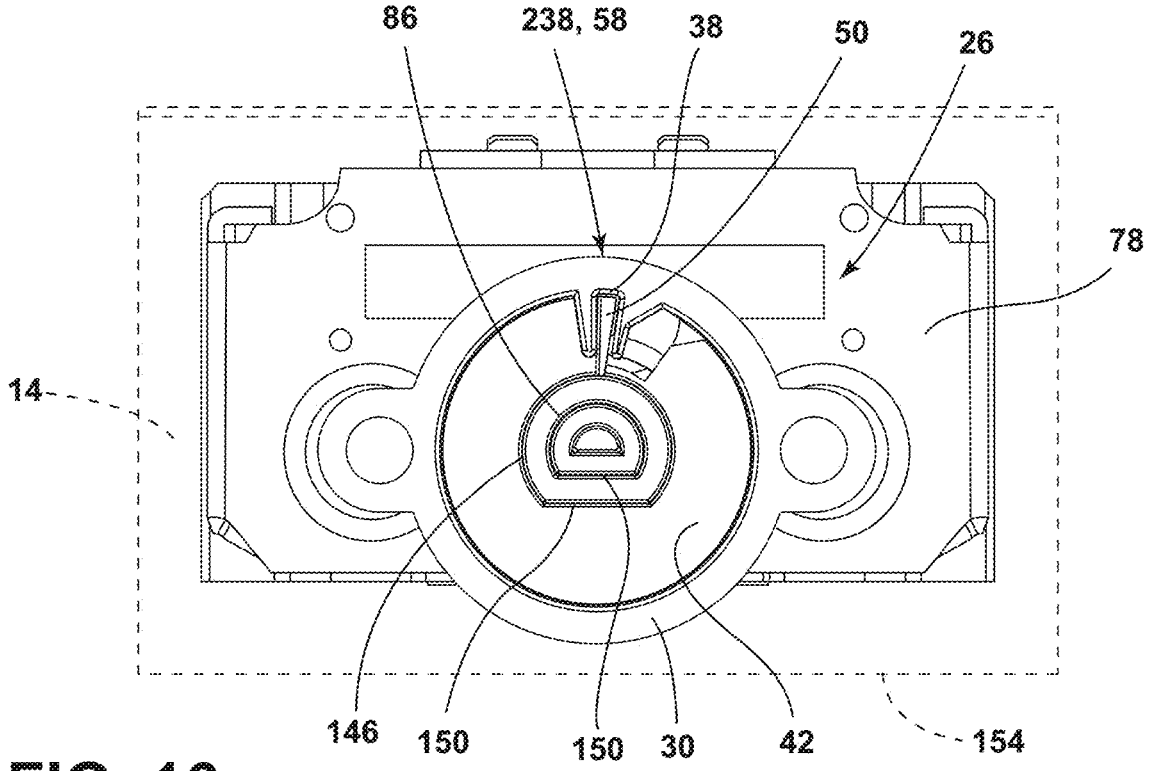
FIG. 16 is a schematic front view of a knob assembly in a first position of the present disclosure.

Referring again to FIGS. 13-15, the knob assembly 26 is depicted as assembled in a locked position 238 with the selective stopper 50 positioned between a first leg 242 and a second leg 246 of the retention member 38. The plinth 146 and the elongated portion 86 are illustrated as being generally cylindrical with a flat retaining surface 304, such that the selective stopper 50 may be positioned at the predefined angular position 158 of the plinth 146 and the elongated portion 86, typically in opposition to the flat retaining surface 304. The first housing 30 has a larger construction than the operable second housing 42 such that the operable second housing 42 fits within the first housing 30. The first housing 30 also may include first and second lobes 250, 254 configured to receive fasteners. Accordingly, the first housing 30 may be coupled to the interior surface 22 of the front panel 14 (FIG. 3) via the fasteners that may extend through the first and second lobes 250, 254. Alternatively, the fasteners may extend through the first and second lobes 250, 254 to couple the first housing 30 to the electromechanical switch 78 (FIG. 16).

As depicted, the first housing 30 is generally cylindrical with an open top 262 and the base 130 defining the central opening 198. Additionally, a channel 266 is shown defined by the base 130 directly below the retention member 38, which may ease manufacture by creating a place through which a tool may form the retention member 38. As shown, the retention member 38 extends inwardly from the sidewall 34 of the first housing 30 to define the first and second legs 242, 246. The first and second legs 242, 246 are illustrated as having generally equal height H and length L. However, it is also contemplated that the first and second legs 242, 246 may have varying heights H and lengths L such that, for example, the height H of the first leg 242 may extend towards the base 130 while the height H of the second leg 246 may remain the illustrated height H. The height H of the second leg 246 is generally proportional to the pocket 114 defined between the central portion 106 and the encoder 110 as well as the gap 126 defined between the base 130 of the first housing 30 and the base edge 134 of the operable second housing 42 (FIG. 5). Thus, the user may move the operable second housing 42 relative the first housing 30 to maneuver the selective stopper 50 around the retention member 38, such that the selective stopper 50 is first shifted downward along the height H of each of the first and second legs 242, 246 passed under the second leg 246, and then extended upward along the height H of the second leg 246. The illustrated second leg 246 defines an angled portion 270 that may assist in the poka-yoke design of the knob assembly 26. Additionally, the angled portion 270 may serve as an indicator or tactile feedback for the user when rotating the operable second housing 42 in the counterclockwise direction as to when the user should press inward on the operable second housing 42 to return the knob assembly 26 to the locked position 238.

Figure 17:
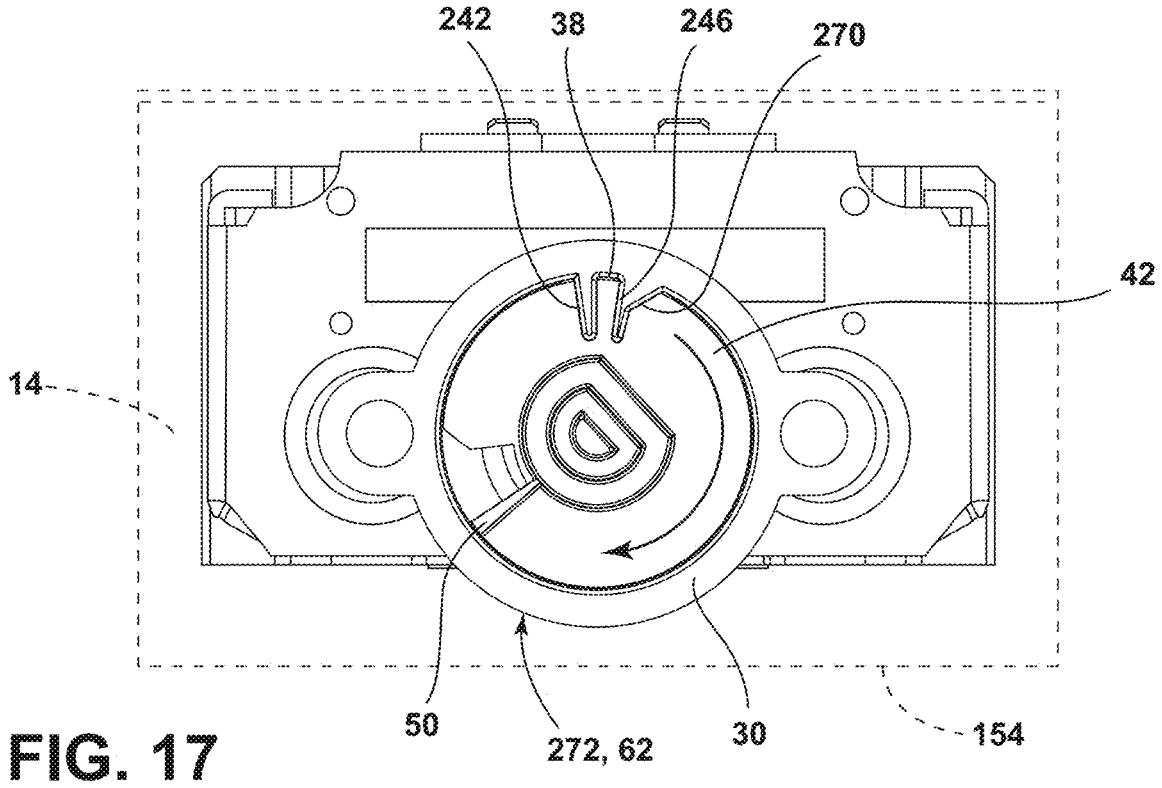
FIG. 17 is a schematic front view of a knob assembly in a second position of the present disclosure.
Figure 18:
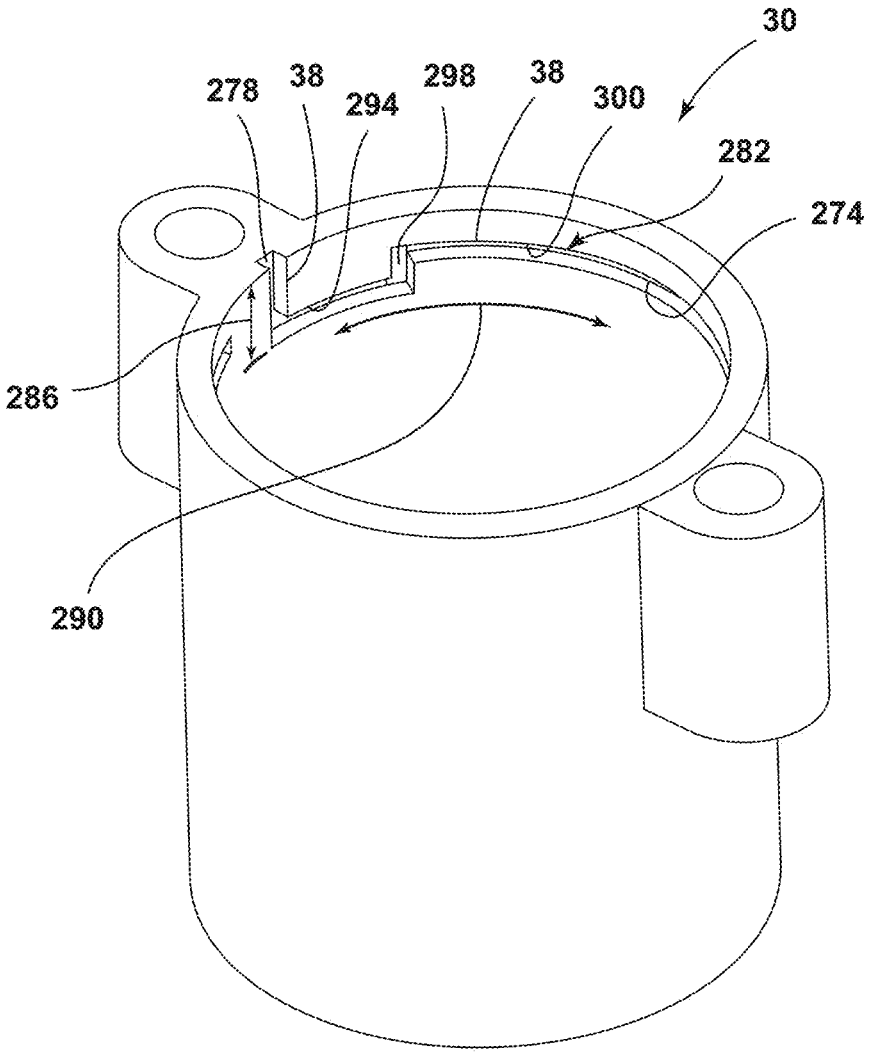
FIG. 18 is a side perspective view of a first housing of the present disclosure.

Referring again to FIGS. 16 and 17, the knob assembly 26 is coupled to the electromechanical switch 78 and illustrated in the locked position 238 (FIG. 16) and an unlocked position 272 (FIG. 17). Typically, the locked position 238 corresponds with the first position 58 and the unlocked position 272 corresponds with the second position 62. When in the first position 58, the operable second housing 42 is in the extended position 172 and is rotationally fixed in that the operable second housing 42 does not move in either the clockwise or the counterclockwise direction. The operable second housing 42 is prevented from such movement by the selective stopper 50 being positioned in the first position 58. However, when in the first position 58, the operable second housing 42 is axially operable, as described above. Accordingly, as illustrated in FIGS. 16 and 17, the operable second housing 42, when in the first position 58, can be axially repositioned into the first housing 30 in the compressed position 178 to release the selective stopper 50 from the retention member 38. Thus, even when in the locked position 238, the selective stopper 50 may transition into the compressed position 178 that is indicative of the unlocked position 272, or second position 62, via axial movement. The axial movement of the operable second housing 42 is illustrated in FIGS. 7 and 8 by the extended position 174 and the compressed position 178 of the helical spring 138. Although illustrated as the helical spring 138, it is also contemplated that the other variations of the biasing member 66 results in the same axial movement.

As illustrated in FIG. 17, the operable second housing 42 is rotationally operable while in the unlocked or second position 272, 62 such that the operable second housing 42 can rotate in either the clockwise or counterclockwise direction via rotational movement. Typically, the operable second housing 42 may rotate to a rotational position of approximately 240-degrees away from the locked position 238; however, it is also contemplated that the operable second housing 42 may complete a full rotation in the clockwise direction such that the selective stopper 50 may re-enter the locked position 238 by passing under the first leg 242.

Referring again to FIGS. 18-20, the retention member 38 of the first housing 30 is illustrated as a guide slot 274 with a first groove 278 and a second groove 282. Generally, the first groove 278 is oriented in a first direction 286 and the second groove 282 is oriented in a second direction 290 generally perpendicular to the first direction 286. Additionally, the second groove 282 may have varied positions, such that the second groove 282 defines an entry portion 294, a transition portion 298, and a guide portion 300. The entry portion 294 of the second groove 282 receives the selective stopper 50 from the first groove 278. This entry portion 294 may be indicative of the compressed position 178. The selective stopper 50 may rotate along the entry portion 294 and enter the guide portion 300 via the transition portion 298, such that the guide portion 300 is offset from the entry portion 294. Stated differently, the first groove 278, the entry portion 294, and the transition portion 298 generally form an imbalanced U-shape, where the transition portion 298 is parallel with, but shorter than and rotationally offset from, the first groove 278. In addition, the entry portion 294 may be generally shorter than the guide portion 300. Accordingly, the selective stopper 50 moves along a greater circumference of the first housing 30 while disposed within the guide portion 300 than compared with the entry portion 294. Alternatively, the entry portion 294 may define a greater or equal portion of the circumference of the first housing 30 as compared with the guide portion 300.

Figure 19:
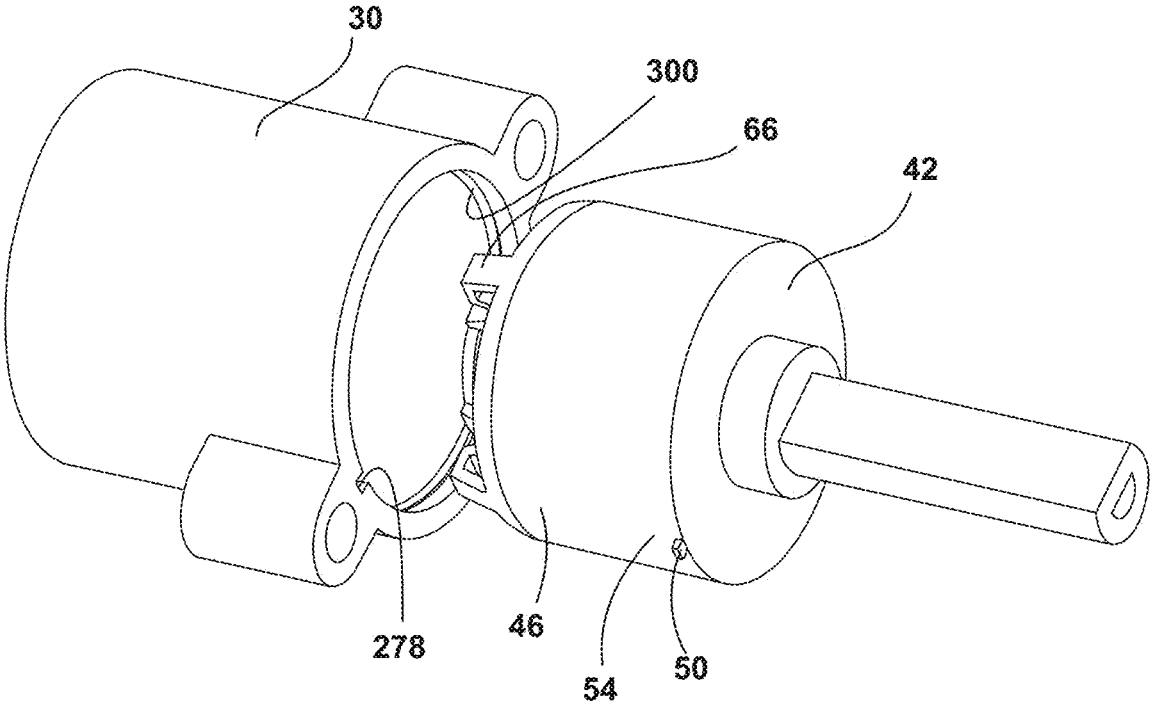
FIG. 19 is an exploded side perspective view of a first housing and an operable second housing of a knob assembly of the present disclosure.

As depicted in FIG. 19, the selective stopper 50 is disposed on the side of the surface 54 of the body 46 of the operable second housing 42. In such configuration, the selective stopper 50 can be received by the first groove 278 of the first housing 30 when the knob assembly 26 is constructed. This configuration allows for the similar poka-yoke assembly process discussed above. Similar to as described above, when the user is deactivating the knob assembly 26, the operable second housing 42 is rotated in the counterclockwise direction until the selective stopper 50 enters the transition portion 298 of the second groove 282. Since the operable second housing 42 will be prevented from additional counterclockwise movement, the user will be notified, via tactile feedback in the form of the stopper 50 abutting the transition portion 298, to apply a compression force to the operable second housing 42. This applied compression force places the operable second housing 42 further in the compressed position 178. The user may then continue the counterclockwise rotation through the entry portion 294 until the selective stopper 50 reaches the first groove 278, and where the biasing member exerts a biasing force that transitions the operable second housing 42 into the extended position 174.

Figure 20:
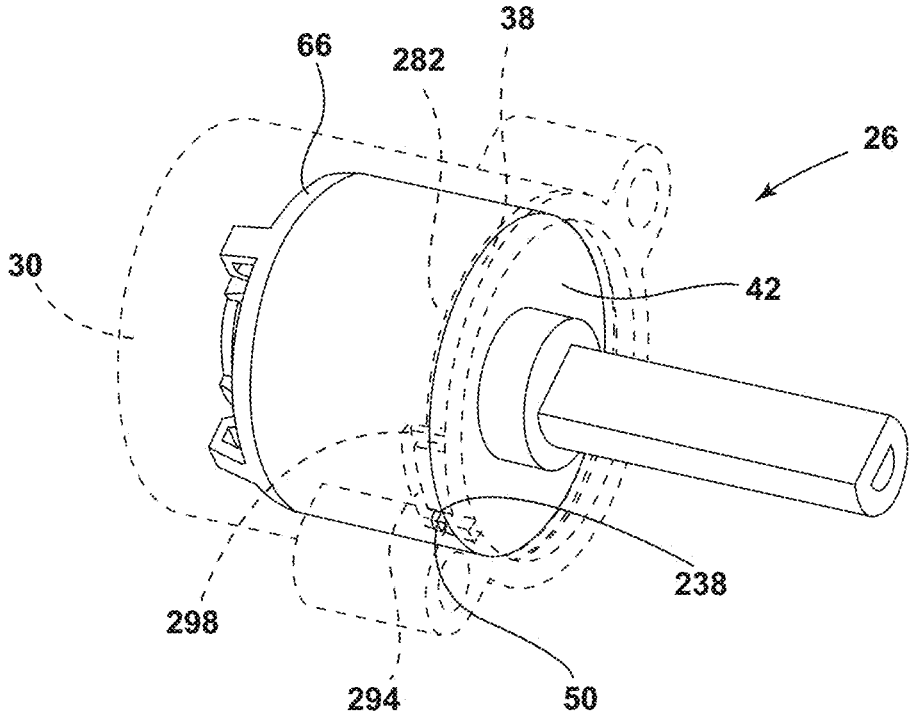
FIG. 20 is a side perspective view of a knob assembly including a first housing in phantom and an operable second housing of the present disclosure.

The opposite steps may be used to activate the knob assembly 26 in the clockwise direction. For example, when the operable second housing 42 is in the locked position 238, the selective stopper 50 is positioned in the first groove 278 and is accordingly axially operable but rotationally fixed, whereas when the selective stopper 50 is in the entry portion 294, the operable second housing 42 is rotationally operable and axially fixed. Once the operable second housing 42 rotates sufficiently within the entry portion 294 such that the selective stopper 50 rotates into the transition portion 298, the operable second housing 42 extends as a result of the biasing force of the biasing member 66, and the selective stopper 50 enters into the guide portion 300. The disposition of the selective stopper 50 within the retention member 38 is illustrated in FIG. 20 with the retention member 38 and the first housing 30 illustrated in phantom. As shown, the selective stopper 50 is positioned partially compressed in the first groove 278. Although depicted with the integral biasing member 66, any of the biasing members 66 discussed herein may be used with the knob assembly 26 as described.

According to another aspect of the present disclosure, an appliance includes a front panel having an exterior surface and an interior surface. A knob assembly is rotationally coupled to the front panel and includes a first housing having a sidewall and a retention member inwardly extending from the sidewall. The knob assembly includes an operable second housing rotationally operable and axially operable relative to the first housing and having a body and a selective stopper disposed on a surface of the body. The selective stopper moves between a first position and a second position relative to a retention member, and an axial biasing member is disposed between the first housing and the operable second housing.

According to another aspect of the present disclosure, an appliance includes an elongated portion extending from a body of an operable second housing. The elongated portion is a user interface of a knob assembly.

According to yet another aspect of the present disclosure, the appliance includes a selective stopper of the operable second housing. The selective stopper is retained by a retaining member of the first housing that defines a locked position.

According to another aspect of the present disclosure, the first position is defined by the selective stopper positioned within a retention member.

According to another aspect of the present disclosure, the operable second housing is axially operable between a compressed position and an extended position. The operable second housing is rotationally operable between the first and second positions.

According to yet another aspect of the present disclosure, the operable second housing is rotationally operable between the first position and the second position when in a compressed position.

According to another aspect of the present disclosure, the axial biasing member is integral with the operable second housing. The operable second housing includes a support member that biases against a base of the first housing, and compression portions extend between a body and a support member.

According to another aspect of the present disclosure, the compression portions are defined by living hinges of the operable second housing.

According to yet another aspect of the present disclosure, a knob assembly of an appliance comprises a first housing and includes a sidewall that defines a cavity and a retention member. The operable second housing includes a selective stopper disposed on a surface of a body. The selective stopper is movable between a first position and a plurality of second positions relative to the retention member. The biasing member is disposed between a first housing and an operable second housing that is defined by a compressed position and an extended position of the operable second housing.

According to another aspect of the present disclosure, the knob assembly includes a retention member that defines a guide slot that has a first groove and a second groove. The selective stopper is retained by a first groove of a guide slot in a first position.

According to another aspect of the present disclosure, the selective stopper is positioned within the second groove of the guide slot that defines a second position. The operable second housing is axially fixed and rotationally operable within a second position.

According to yet another aspect of the present disclosure, the knob assembly includes an operable second housing in the compressed position when the selective stopper moves from a first position to one of the plurality of second positions.

According to another aspect of the present disclosure, a base of the first housing defines a central opening. An electromechanical switch extends through the central opening.

According to another aspect of the present disclosure, a locked position is defined by a selective stopper that is positioned within a retention member. The operable second housing is axially operable and rotationally fixed within the locked position.

According to yet another aspect of the present disclosure, the first housing of a knob assembly includes a sidewall that extends from a base and a retention member inwardly extending from a sidewall. The operable second housing includes a selective stopper that is movable between a first position and a second position relative to the retention member. The operable second housing is further axially operable between a compressed position and an extended position relative to the first housing. The operable second housing includes a biasing member.

According to another aspect of the present disclosure, the selective stopper is retained by a retention member that defines a first position and an operable second housing that is rotationally fixed and axially operable to the first position.

According to another aspect of the present disclosure, the biasing member is integral with the operable second housing and includes living hinges that are coupled to a support member that is biased against a base of the first housing.

According to yet another aspect of the present disclosure, the biasing member is a leaf spring that is positioned in a gap that is defined between the first housing and the operable second housing.

According to still yet another aspect of the present disclosure, the retention member includes a first leg and a second leg. The selective stopper is retained between the first leg and the second leg of the retention member to define a locked position.

According to another aspect of the present disclosure, an unlocked position is defined by the selective stopper that is disposed outside the retention member in a second position, and the operable second housing is rotationally and axially operable.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An appliance, comprising:

a front panel having an exterior surface and an interior surface;

a knob assembly rotationally coupled to the front panel, the knob assembly including:

a first housing having a sidewall and a retention member inwardly extending from the sidewall;

an operable second housing rotationally operable and axially operable relative the first housing and having a body and a selective stopper disposed on a surface of the body, wherein the selective stopper is selectively movable between a first position and a second position relative to the retention member; and an axial biasing member disposed between the first housing and the operable second housing, wherein the axial biasing member is integral with the operable second housing, and wherein the operable second housing includes:

a support member that biases against a base of the first housing; and compression portions extending between the body and the support member.

2. The appliance of claim 1, wherein an elongated portion extends from the body of the operable second housing, and wherein the elongated portion is a user interface of the knob assembly.

3. The appliance of claim 1, wherein the selective stopper of the operable second housing is retained by the retention member of the first housing to define a locked position.

4. The appliance of claim 1, wherein the first position is defined by the selective stopper positioned within the retention member.

5. The appliance of claim 1, wherein the operable second housing is axially operable between a compressed position and an extended position, and further wherein the operable second housing is rotationally operable between the first and second positions.

6. The appliance of claim 5, wherein the operable second housing is rotationally operable between the first and second positions when in the compressed position.

7. The appliance of claim 1, wherein the compression portions are defined by living hinges of the operable second housing.

8. A knob assembly for an appliance, comprising:

a first housing including a sidewall defining a cavity and a retention member;

an operable second housing including a body and a selective stopper disposed on a surface of the body, wherein the selective stopper is selectively movable between a first position and a plurality of second positions relative to the retention member; and a biasing member disposed between the first housing and the operable second housing that defines a compressed position and an extended position of the operable second housing, wherein the retention member defines a guide slot having a first groove and a second groove, and wherein the selective stopper is retained by the first groove of the guide slot in the first position.

9. The knob assembly of claim 8, wherein the selective stopper is positioned within the second groove of the guide slot to define the second position, and wherein the operable second housing is axially fixed and rotationally operable within the second position.

10. The knob assembly of claim 8, wherein the operable second housing is in the compressed position when the selective stopper moves from the first position to one of the plurality of second positions.

11. The knob assembly of claim 8, wherein a base of the first housing defines a central opening through which an electromechanical switch extends.

12. The knob assembly of claim 8, wherein a locked position is defined by the selective stopper positioned within the retention member, and wherein the operable second housing is axially operable and rotationally fixed within the locked position.

13. A knob assembly, comprising:

a first housing including a sidewall extending from a base and a retention member inwardly extending from the sidewall; and an operable second housing including a selective stopper selectively movable between a first position and a second position relative to the retention member; wherein, the operable second housing is further axially operable between a compressed position and an extended position relative to the first housing, and wherein the operable second housing includes a biasing member, wherein the biasing member is a leaf spring positioned in a gap defined between the first housing and the operable second housing;

and wherein, an unlocked position is defined by the selective stopper disposed outside the retention member in the second position, and wherein the operable second housing is rotationally and axially operable.

14. The knob assembly of claim 13, wherein the selective stopper is retained by the retention member to define the first position, and wherein the operable second housing is rotationally fixed and axially operable in the first position.

15. The knob assembly of claim 13, wherein the retention member includes a first leg and a second leg, wherein the selective stopper is retained between the first and second legs of the retention member to define a locked position.

* * * * *